US011081065B2

(12) United States Patent
Mao

(10) Patent No.: US 11,081,065 B2
(45) Date of Patent: Aug. 3, 2021

(54) DISPLAY CONTROL APPARATUS AND METHOD HAVING DYNAMIC BACKLIGHT ADJUSTING MECHANISM

(71) Applicant: Realtek Semiconductor Corporation, Hsinchu (TW)

(72) Inventor: Wen-Yi Mao, Suzhou (CN)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 0 days.

(21) Appl. No.: 17/016,672

(22) Filed: Sep. 10, 2020

(65) Prior Publication Data

US 2021/0097942 A1 Apr. 1, 2021

(30) Foreign Application Priority Data

Sep. 26, 2019 (CN) ..... 201910918689.9

(51) Int. Cl.
*G09G 3/34* (2006.01)

(52) U.S. Cl.
CPC ... *G09G 3/3406* (2013.01); *G09G 2320/0626* (2013.01)

(58) Field of Classification Search
CPC ..... G09G 3/3406; G09G 2320/064; G09G 2320/0646; G09G 2320/0626
USPC ..... 345/102
See application file for complete search history.

(56) References Cited

U.S. PATENT DOCUMENTS

| | | | | |
|---|---|---|---|---|
| 8,730,149 | B2 * | 5/2014 | Chiang | G09G 3/3406 345/102 |
| 9,218,772 | B2 * | 12/2015 | Kim | G09G 3/3406 |
| 10,902,807 | B2 * | 1/2021 | Chen | G09G 3/3648 |
| 2014/0184485 | A1 | 7/2014 | Kim | |

* cited by examiner

*Primary Examiner* — Koosha Sharifi-Tafreshi
(74) *Attorney, Agent, or Firm* — Locke Lord LLP; Tim Tingkang Xia, Esq.

(57) ABSTRACT

A display control method having dynamic backlight adjusting mechanism is provided that includes the steps outlined below. A backlight control signal having a backlight period that is 1/N times of a Vsync period of a Vsync signal is generated. A first Vsync period end time after the Vsync period switches from a first period length to a second period length is calculated. A first backlight period end time after the first Vsync period end time is determined as a transition period start time. A time difference between the transition period start time and the first Vsync period end time is calculated. A transition period length between the second period length and the time difference is calculated and divided into interval lengths each equals to a third period length. The backlight control signal operated to have the third period length is generated within the transition period.

10 Claims, 4 Drawing Sheets

DISPLAY CONTROL APPARATUS AND METHOD HAVING DYNAMIC BACKLIGHT ADJUSTING MECHANISM

CROSS-REFERENCE TO RELATED APPLICATION

This application claims priority to China Application Serial Number 201910918689.9, filed Sep. 26, 2019, which is herein incorporated by reference in its entirety.

BACKGROUND

Technical Field

The present disclosure relates to a display technology, and more particularly to a display control apparatus and method having a dynamic backlight adjustment mechanism.

Description of Related Art

In an image display apparatus, such as a liquid crystal display, in addition to displaying data, a synchronization signal is required to enable the liquid crystal molecules arranged in an array in the liquid crystal panel to display corresponding images at the correct timing. The image refresh rate is determined by the vertical synchronization signal (Vsync) to achieve the image switching frequency of the display screen. Meanwhile, the backlight circuit also has to determine the switching frequency according to the vertical synchronization signal in order to turn on the backlight at the corresponding frame, so that the user has a better viewing experience.

However, in advanced applications, the display may cause the vertical synchronization signal to change to different vertical synchronization frequencies at different points in time. Under such conditions, if the backlight circuit cannot flexibly adjust the frequency of the backlight control signal, the water ripple phenomena would be generated on the screen and observed by the user.

Therefore, how to design a new display control device and method having a dynamic backlight adjustment mechanism to solve the above-mentioned shortcomings is an urgent problem in the industry.

SUMMARY

This summary is intended to provide a simplified summary of this disclosure so that the reader may have a basic understanding of the disclosure. This summary is not a comprehensive overview of the disclosure, and it is not intended to indicate important/critical elements of the embodiments of the present disclosure or to define the scope of the present disclosure.

An object of the present disclosure is to provide a display control apparatus and method with a dynamic backlight adjustment mechanism, so as to address the problems of the prior art.

For the objects discussed above, a technical aspect of the present disclosure relates to a display control apparatus having a dynamic backlight adjustment mechanism, including: a vertical synchronization signal (Vsync) phase detection circuit, a backlight control signal generating circuit, and a computing circuit. The vertical synchronization signal (Vsync) phase detection circuit is configured to receive and detect a vertical synchronization period of a vertical synchronization signal. The backlight control signal generating circuit is configured to generate a backlight control signal to a display, in which a backlight period of the backlight control signal is 1/N times of the vertical synchronization period. The computing circuit is configured to: when the vertical synchronization period is changed from a first period length to a second period length, calculate an end time of the first vertical synchronization period after the vertical synchronization signal starts operating with the second period length; determine an end time of a first backlight period of the backlight control signal after the end time of the vertical synchronization period as a transition period start time; calculate a time difference between the start time of the transition period and the end time of the vertical synchronization period; calculate a transition period length between the second period length and the time difference, in which the transition period length corresponds to a transition period; divide the transition period length evenly into at least one interval length, each as a third period length, in which each of the interval lengths is closest to 1/N times of the second period length; and generate an adjustment signal to control the backlight control signal generating circuit to generate the backlight control signal having the third period length in the transition period.

Another technical aspect of the present disclosure relates to a display control method with a dynamic backlight adjustment mechanism, including: receiving and detecting, by a vertical synchronization signal phase detection circuit, a vertical synchronization period of a vertical synchronization signal; generating, by a backlight control signal generating circuit, a backlight control signal to a display, in which a backlight period of the backlight control signal is 1/N times of the vertical synchronization period; when the vertical synchronization period is changed from a first period length to a second period length, calculating, by a computing circuit, the end time of the first vertical synchronization period after the vertical synchronization signal starts operating with the second period length; determining, by the computing circuit, an end time of a first backlight period of the backlight control signal after the end time of the vertical synchronization period as a transition period start time; calculating, by the computing circuit, a time difference between the start time of the transition period and the end time of the vertical synchronization period; calculating, by the computing circuit, a transition period length between the second period length and the time difference, in which the transition period length corresponds to a transition period; dividing, by the computing circuit, the transition period length evenly into at least one interval length, each as a third period length, in which each interval length is closest to 1/N times of the second period length; and generating, by the computing circuit, an adjustment signal to control the backlight control signal generating circuit to generate the backlight control signal having the third period length in the transition period.

The display control apparatus and method with a dynamic backlight adjustment mechanism of the present disclosure can dynamically adjust the backlight period of the backlight control signal according to the change of the vertical synchronization period of the vertical synchronization signal to synchronize with the vertical synchronization signal, such that the water ripples phenomena on the screen can be solved.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
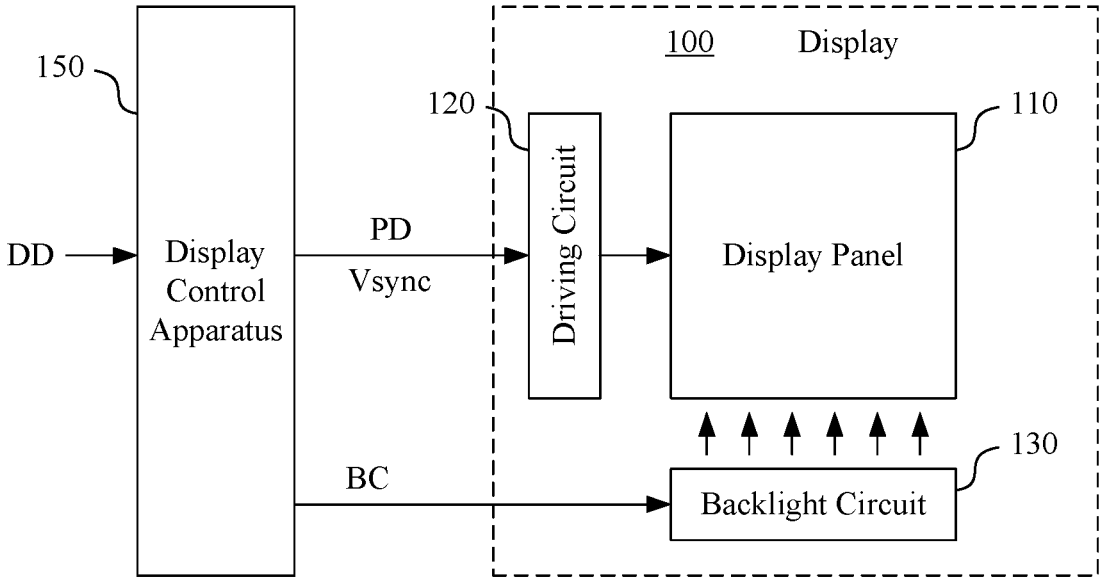
FIG. 1 is a block diagram of a display and a display control apparatus with a dynamic backlight adjustment mechanism according to an embodiment of the present disclosure.

Reference is made to FIG. 1. FIG. 1 is a block diagram of a display 100 and a display control apparatus 150 with a dynamic backlight adjustment mechanism according to an embodiment of the present disclosure.

The display 100 includes a display panel 110, a driving circuit 120, and a backlight circuit 130. In this embodiment, the display 100 is a liquid crystal display and the display panel 110 is a liquid crystal panel, but the present disclosure is not limited thereto.

The driving circuit 120 is configured to drive the display panel 110 according to pixel data PD and a synchronization signal, such as, but not limited to, a vertical synchronization signal Vsync. The vertical synchronization signal Vsync is a frame synchronization signal. In an embodiment, the driving circuit 120 may also generate a horizontal synchronization signal (not illustrated) as a scanning line synchronization signal, so that the display panel 110 receives the pixel data PD to display at the correct timing according to the vertical and horizontal synchronization signals.

The backlight circuit 130 is configured to receive a backlight control signal BC and switch to generate a light source to illuminate the display panel 110 during a turned-on time interval, so that the user can watch the screen according to the pixel data PD received by the display panel 110 and the illumination of the backlight circuit 130.

In one embodiment, the backlight period of the backlight control signal BC is in an integer proportional relationship with the vertical synchronization period of the vertical synchronization signal Vsync to illuminate the display panel 110 according to each display frame. In one embodiment, the backlight period is 1/N times of the vertical synchronization period. It should be noted that in each backlight period, the backlight control signal BC will have a high state and a low state, and its length is determined by the duty cycle, so that the backlight circuit 130 turns on to provide the light source according to the high state, and turns off according to the low state.

The display control apparatus 150 is configured to receive display data DD, and generate the pixel data PD, a synchronization signal including at least a vertical synchronization signal Vsync, and a backlight control signal BC according to the display data DD.

In an embodiment, in order to make the display 100 display more flexibly, the vertical synchronization signal Vsync can dynamically change its vertical synchronization period, so that the display 100 displays in different frame rates, for example, supporting the variable refresh rate (VRR) function. In such a case, the display control apparatus 150 may dynamically adjust the backlight period of the backlight control signal BC according to the change of the vertical synchronization signal Vsync to synchronize with the vertical synchronization signal Vsync and avoid water ripples phenomena on the screen.

The structure of the display control apparatus 150 and the dynamic backlight adjustment mechanism are described in more detail below.

Figure 2:
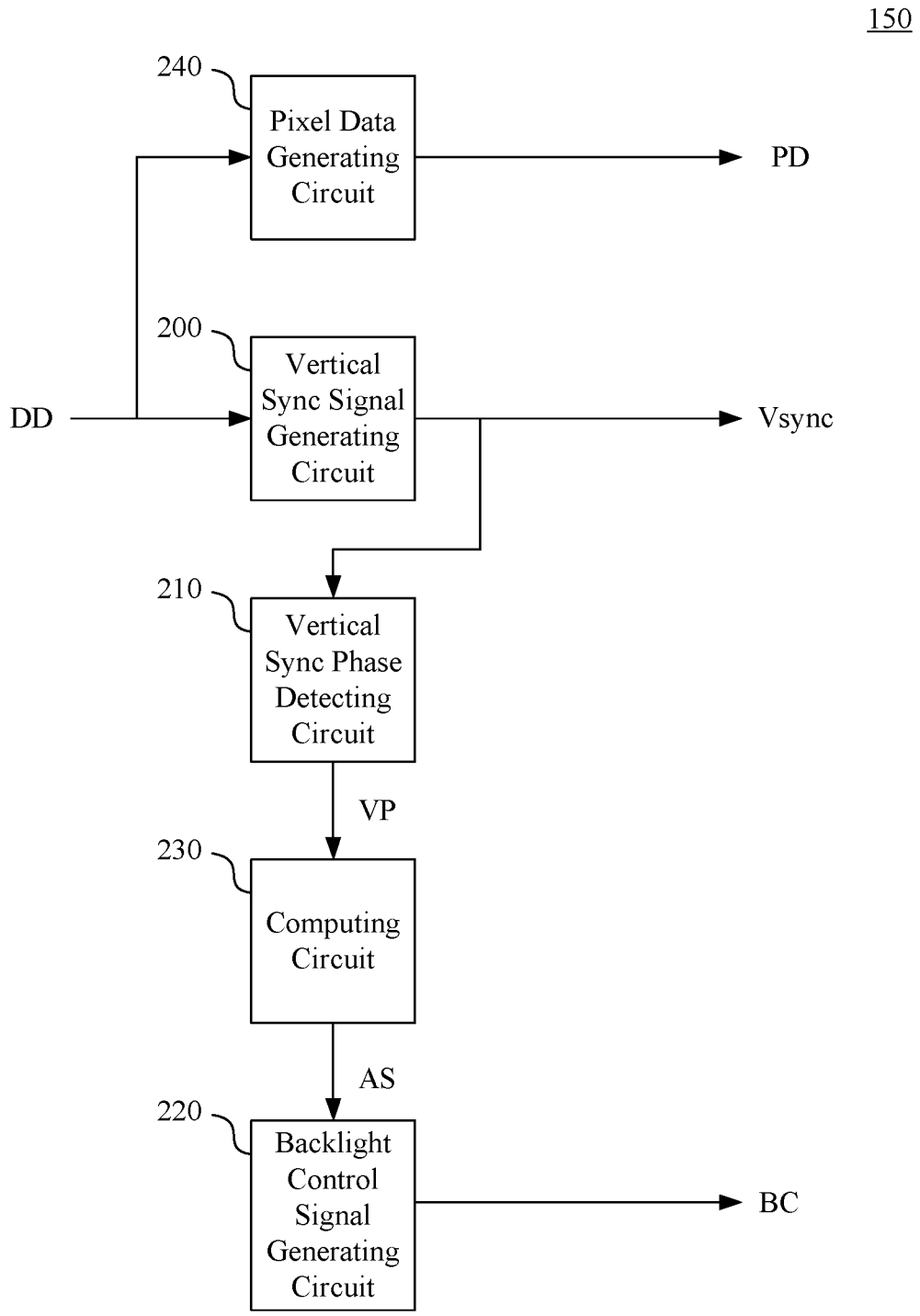
FIG. 2 is a block diagram of a display control apparatus according to an embodiment of the present disclosure.
Figure 3:
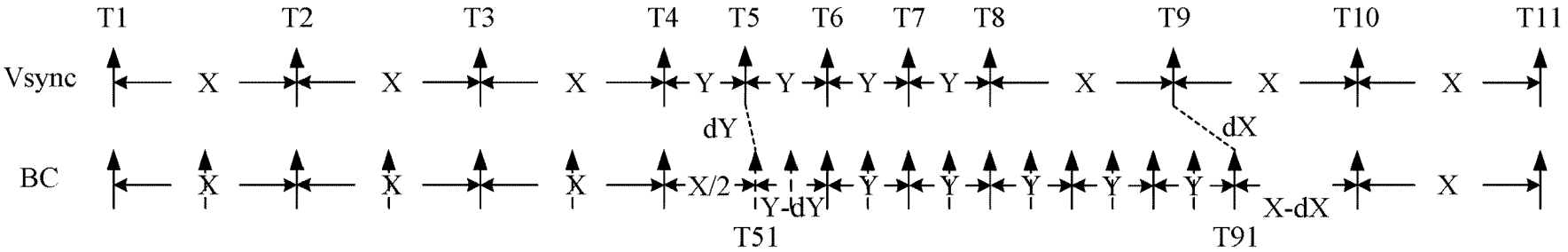
FIG. 3 is a waveform diagram of signals generated by the display control apparatus in operation according to an embodiment of the present disclosure.

Reference is made to FIG. 2 and FIG. 3 simultaneously. FIG. 2 is a block diagram of a display control apparatus 150 according to an embodiment of the present disclosure. FIG. 3 is a waveform diagram of signals generated by the display control apparatus 150 in operation according to an embodiment of the present disclosure.

The display control apparatus 150 includes a vertical synchronization signal generation circuit 200, a vertical synchronization signal phase detection circuit 210, a backlight control signal generation circuit 220, and a computing circuit 230.

The vertical synchronization signal generating circuit 200 is configured to receive the display data DD and generate the vertical synchronizing signal Vsync to the driving circuit 120 of the display 100 according to the display data DD.

The vertical synchronization signal phase detection circuit 210 is configured to receive and detect the vertical synchronization period VP of the vertical synchronization signal Vsync. The vertical synchronization period VP has a variable period length.

As shown in FIG. 3, in an example, at time points T1 to T4, the vertical synchronization signal Vsync operates with a period length X, and at time points T4 to T8, it operates with a period length Y, and finally at time points T8 to T11, it goes back to operate with the period length X. In this example, the period length Y is smaller than the period length X.

The backlight control signal generating circuit 220 is configured to generate the backlight control signal BC to the backlight circuit 130 of the display 100. The backlight period of the backlight control signal BC is 1/N times of the vertical synchronization period. In one embodiment, N is a positive integer greater than or equal to two.

As shown in FIG. 3, in this embodiment, N=2 is taken as an example. That is, the backlight control signal BC operates with a backlight period having a half of the vertical synchronization period. In more detail, there will be two backlight periods in each vertical synchronization period. Taking the period length X of the vertical synchronization signal Vsync at the time points T1 to T4 as an example, the length of each backlight period in this time interval will be X/2.

The computing circuit 230 is configured to perform an operation when the vertical synchronization period is changed by the period length, and dynamically adjust the backlight period of the backlight control signal BC according to the operation result to avoid the occurrence of water ripple phenomena.

Taking the vertical synchronization signal Vsync changed from period length X to period length Y at the time point T4 as an example, the computing circuit 230 calculates the end time of the first vertical synchronization period after the vertical synchronization signal starts to operate with the period length Y, that is, the position of the time point T5.

Next, the computing circuit 230 determines an end time of a first backlight period of the backlight control signal BC after the end time (the time point T5) of the vertical synchronization period as a transition period start time. The end time of the first backlight period is marked as a time point T51.

Further, the computing circuit 230 calculates a time difference dY between a transition period start time (the time point T51) and a vertical synchronization period end time (the time point T5). Moreover, the computing circuit 230 calculates a transition period length Y−dY between the period length Y and the time difference dY. The transition period length Y−dY corresponds to a transition period in which the backlight period length of the backlight control signal BC is changed from X/2 to Y/2. In this embodiment, the transition period is an interval corresponding to the time point T51 to the time point T6.

The computing circuit 230 divides the transition period length Y−dY evenly into at least one interval length, each of which is used as the transition period length. The length of each interval is closest to 1/N times of the period length Y. Since N is 2 in this embodiment, each interval length will be closest to the period length Y/2.

In one embodiment, the computing circuit 230 sets a reference length as 1/N times of the period length Y. When the transition period length Y−dY is divided into N−1 interval lengths, each interval length will be (Y−dY)/(N−1). At this time, the computing circuit 230 can calculate that a gap D1 between each interval length and the reference length is |Y/N−(Y−dY)/(N−1)| under such a situation.

When the transition period length Y−dY is divided into N interval lengths, each interval length will be (Y−dY)/N. At this time, the computing circuit 230 can calculate that under such a situation, a gap D2 between each interval length and the reference length is |Y/N−(Y−dY)/N|.

The computing circuit 230 compares the magnitude relationship of the gaps in the two situations. In an embodiment, when the gap D2 is smaller than the gap D1, the computing circuit 230 selects to divide the transition period length Y−dY into N interval lengths. When the gap D2 is not smaller than the gap D1 (that is, when the gap D2 is greater than or equal to the gap D1), the computing circuit 230 will choose to divide the transition period length Y−dY into N−1 interval lengths.

Taking the transition period length Y−dY in FIG. 3 and N=2 as an example, when the transition period length Y−dY is divided into one interval length, each interval length will be Y−dY. The gap D1 is |Y/2−(Y−dY)|. When the transition period length Y−dY is divided into two interval lengths, each interval length will be (Y−dY)/2. The gap D2 is |Y/2−(Y−dY)/2|.

When the gap D1 is smaller, it means that the transition period length Y−dY per se is close to the new backlight period length Y/2. Therefore, the computing circuit 230 selects to divide the transition period length Y−dY into one interval length, and uses this interval length as the transition period length.

When the gap D2 is smaller, it means that the transition period length Y−dY is to be divided into two interval lengths, such that each interval length is close to the new backlight cycle length Y/2. Therefore, the computing circuit 230 selects to divide the transition period length Y−dY into two interval lengths, and uses each interval length as a transition period length. Taking FIG. 3 as an example, since the gap D2 is smaller than the gap D1, the computing circuit 230 divides the transition period length Y−dY into two interval lengths.

According to the above selection, the computing circuit 230 will generate an adjustment signal AS to control the backlight control signal generation circuit 220 to generate a backlight control signal BC with a transition period length (eg, Y−dY or (Y−dY)/2) during the transition period.

Next, the backlight control signal generating circuit 220 will generate a backlight control signal BC with a backlight period of 1/N times of the period length Y after the transition period, that is, after the time point T6. In the case where N is 2 in this embodiment, the backlight control signal generating circuit 220 will generate a backlight control signal BC with a backlight period Y/2 after the transition period.

Similarly, when the vertical synchronization signal Vsync operates at the time point T8, back with the period length X, the computing circuit 230 may also determine the transition period start time and calculate the time difference dX according to the end time (a time point T9) of the first vertical synchronization period after the vertical synchronization signal Vsync changes to the period length X and the end time (a time point T91) of the first backlight period after the end time of the vertical synchronization period of the backlight control signal BC.

Further, the computing circuit 230 may calculate the transition period length X−dX according to a new period length X and the time difference dX, and then, based on the relationship between the interval length generated under different division conditions of the transition period length X−dX and the new period length X, determines the number of intervals to be divided by the transition period length X−dX, and then generate the adjustment signal AS to control the backlight control signal generation circuit 220 to generate the backlight control signal BC in the transition period from the time point T91 to a time point T10. After the transition period (i.e., after the time point T10), the backlight control signal generating circuit 220 will generate a backlight control signal BC with a backlight period of X/2.

In an embodiment, the display control apparatus 150 also includes other circuits for generating display-related driving signals to drive the driving circuit 120. For example, the display control apparatus 150 includes a pixel data generating circuit 240 configured to receive the display data DD and generate the pixel data PD to the driving circuit 120 of the display 100 according to the display data DD. The present disclosure is not limited to this.

Accordingly, the display control apparatus 150 having a dynamic backlight adjusting mechanism of the present disclosure may dynamically adjust the backlight period of the backlight control signal BC according to the change of the vertical synchronization period of the vertical synchronization signal Vsync, to synchronize with the vertical synchronization signal Vsync and avoid water ripples phenomena on the screen.

It should be noted that the above-mentioned computing circuit 230 may be implemented by a combination of various hardware computing unit circuits such as an adder, a multiplier and a comparator. In addition, each circuit in the display control apparatus 150 may be integrated into a system on a chip (SoC).

Figure 4:
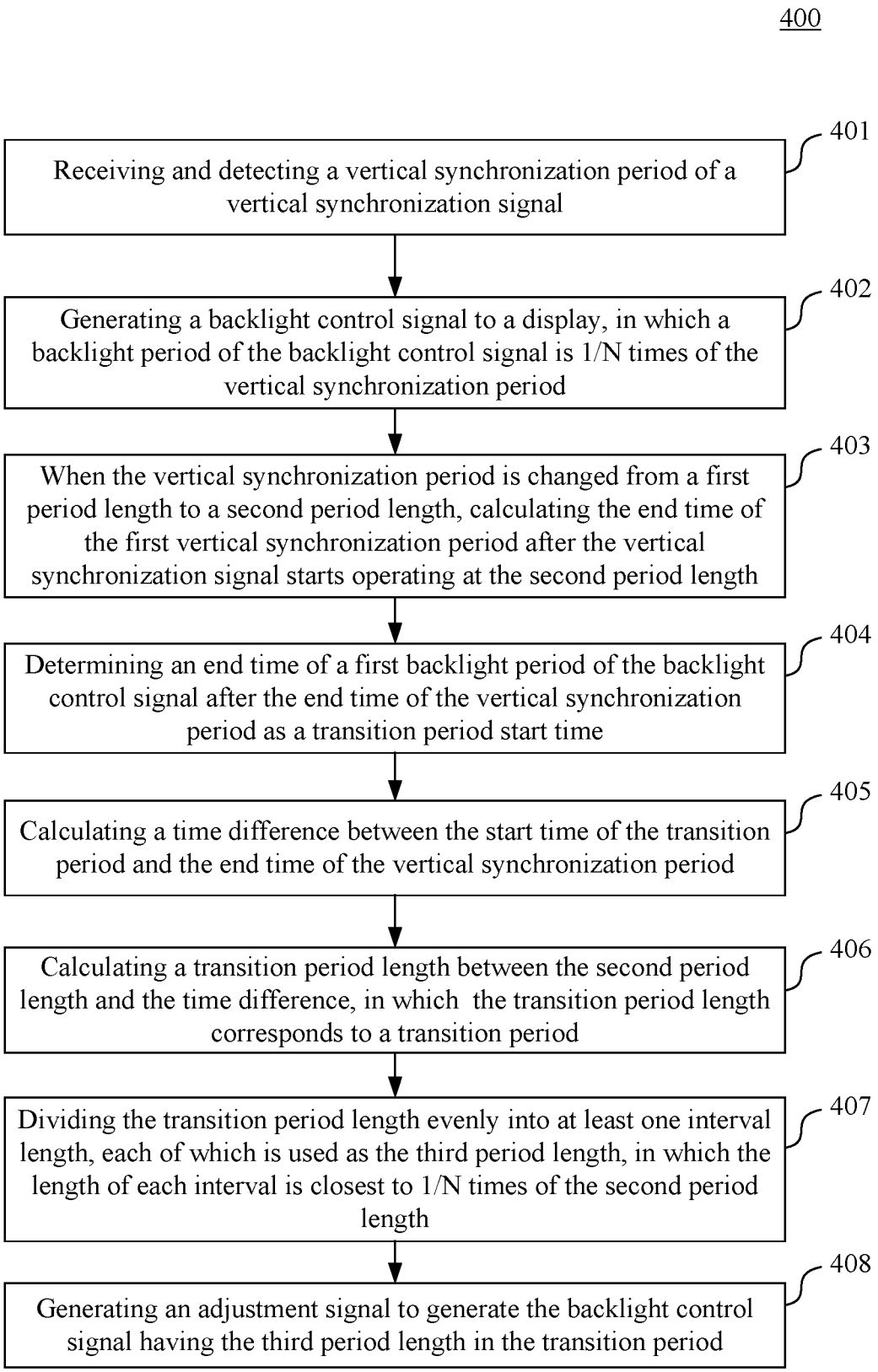
FIG. 4 is a flowchart of a display control method with a dynamic backlight adjustment mechanism according to an embodiment of the present disclosure.

FIG. 4 is a flowchart of a display control method 400 with a dynamic backlight adjustment mechanism according to an embodiment of the present disclosure.

The display control method 400 can be applied to a display control apparatus 150 as shown in FIG. 2. The display control method 400 includes the following steps (it should be noted that the steps mentioned in the detailed description can be adjusted according to actual needs, and can be performed simultaneously or partially simultaneously, unless the order is specifically described).

At step 401, the vertical synchronization signal phase detection circuit 200 receives and detects the vertical synchronization period VP of the vertical synchronization signal Vsync.

At step 402, a backlight control signal generating circuit 220 generates a backlight control signal BC to a backlight circuit 130 of a display 100, in which a backlight period of the backlight control signal BC is 1/N times of the vertical synchronization period VP.

At step 403, when the vertical synchronization period VP is changed from a first period length (e.g., the period length X in FIG. 3) to a second period length (e.g., the period length Y in FIG. 3), the computing circuit 230 calculates the end time (e.g., the time point T5 in FIG. 3) of the first vertical synchronization period after the vertical synchronization signal Vsync starts operating with the second period length.

At step 404, the computing circuit determines an end time (e.g., the time point T51 in FIG. 3) of a first backlight period of the backlight control signal BC after the end time of the vertical synchronization period as a transition period start time.

At step 405, the computing circuit calculates a time difference (e.g., the time difference dY in FIG. 3) between the start time of the transition period and the end time of the vertical synchronization period.

At step 406, the computing circuit 230 calculates a transition period length (e.g., the period length Y−dY in FIG. 3) between the second period length and the time difference, in which the transition period length corresponds to a transition period.

At step 407, the computing circuit 230 divides the transition period length Y−dY evenly into at least one interval length, each of which is used as the third period length. The length of each interval is closest to 1/N times of the second period length.

At step 408, the computing circuit 230 generates an adjustment signal to control the backlight control signal generating circuit 220 to generate the backlight control signal BC having the third period length in the transition period.

Although the present invention has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A display control apparatus having a dynamic backlight adjustment mechanism, comprising:

a vertical synchronization signal (Vsync) phase detection circuit configured to receive and detect a vertical synchronization period of a vertical synchronization signal;

a backlight control signal generating circuit configured to generate a backlight control signal to a display, wherein a backlight period of the backlight control signal is 1/N times of the vertical synchronization period; and a computing circuit configured to:

when the vertical synchronization period is changed from a first period length to a second period length, calculate an end time of the first vertical synchronization period after the vertical synchronization signal starts operating with the second period length;

determine an end time of a first backlight period of the backlight control signal after the end time of the vertical synchronization period as a transition period start time;

calculate a time difference between the start time of the transition period and the end time of the vertical synchronization period;

calculate a transition period length between the second period length and the time difference, wherein the transition period length corresponds to a transition period;

divide the transition period length evenly into at least one interval length, each as a third period length, wherein each of the interval lengths is closest to 1/N times of the second period length; and generate an adjustment signal to control the backlight control signal generating circuit to generate the backlight control signal having the third period length in the transition period.

2. The display control apparatus of claim 1, wherein the computing circuit is further configured to:

set 1/N times of the second period length as a reference length;

divide the transition period length into (N−1) interval lengths, respectively, as a first length, and calculate a first gap between the first length and the reference length;

divide the transition period length into N interval lengths, respectively, as a second length, and calculate a second gap between the second length and the reference length;

when the second gap is smaller than the first gap, the transition period length is divided into N interval lengths; and when the second gap is not smaller than the first gap, the transition period length is divided into N−1 interval lengths.

3. The display control apparatus of claim 1, wherein after the transition period, the backlight control signal generating circuit is configured to generate, the backlight control signal with the backlight period of 1/N times of the second period length.

4. The display control apparatus of claim 1, further comprising:

a vertical synchronization signal generating circuit configured to receive a display data and generate the vertical synchronization signal to a driving circuit of the display according to the display data.

5. The display control apparatus of claim 4, further comprising:

a pixel data generating circuit configured to receive the display data, and generate a pixel data to the driving circuit of the display according to the display data.

6. A display control method with a dynamic backlight adjustment mechanism, comprising:

receiving and detecting, by a vertical synchronization signal phase detection circuit, a vertical synchronization period of a vertical synchronization signal;

generating, by a backlight control signal generating circuit, a backlight control signal to a display, wherein a backlight period of the backlight control signal is 1/N times of the vertical synchronization period;

calculating, when the vertical synchronization period is changed from a first period length to a second period length, by a computing circuit, the end time of the first vertical synchronization period after the vertical synchronization signal starts operating with the second period length;

determining, by the computing circuit, an end time of a first backlight period of the backlight control signal after the end time of the vertical synchronization period as a transition period start time;

calculating, by the computing circuit, a time difference between the start time of the transition period and the end time of the vertical synchronization period;

calculating, by the computing circuit, a transition period length between the second period length and the time difference, wherein the transition period length corresponds to a transition period;

dividing, by the computing circuit, the transition period length evenly into at least one interval length, each as a third period length, wherein each interval length is closest to 1/N times of the second period length; and generating, by the computing circuit, an adjustment signal to control the backlight control signal generating circuit to generate the backlight control signal having the third period length in the transition period.

7. The display control method of claim 6, further comprising:

setting, by the computing circuit, 1/N times of the second period length as a reference length;

dividing, by the computing circuit, the transition period length into N−1 interval lengths, respectively, as a first length, and calculating a first gap between the first length and the reference length;

dividing, by the computing circuit, the transition period length into N interval lengths, respectively, as a second length, and calculating a second gap between the second length and the reference length;

when the second gap is smaller than the first gap, dividing the transition period length, by the computing circuit, into N interval lengths; and when the second gap is not smaller than the first gap, dividing the transition period length, by the computing circuit, into N−1 interval lengths.

8. The display control method of claim 6, further comprising:

generating, by the backlight control signal generating circuit, the backlight control signal with the backlight period of 1/N times of the second period length after the transition period.

9. The display control method of claim 6, further comprising:

receiving, by a vertical synchronization signal generating circuit, a display data, and generating the vertical synchronization signal to a driving circuit of the display according to the display data.

10. The display control method of claim 9, further comprising:

receiving, by a pixel data generating circuit, the display data, and generating a pixel data to the driving circuit of the display according to the display data.

* * * * *